United States Patent [19]

Poltash

[11] Patent Number: 4,480,882

[45] Date of Patent: Nov. 6, 1984

[54] DISPLAY CASE FOR JEWELRY AND THE LIKE

[76] Inventor: Lawrence M. Poltash, 517 3rd St., Manhattan Beach, Calif. 90266

[21] Appl. No.: 466,632

[22] Filed: Feb. 15, 1983

[51] Int. Cl.[3] ..... A47B 81/00

[52] U.S. Cl. ..... 312/107; 312/117; 312/125; 312/135; 211/163

[58] Field of Search ..... 312/107, 114, 266, 117, 312/125, 135, 244, 248; D6/145, 173, 175, 151, 154; 211/163, 78, 70

[56] References Cited

U.S. PATENT DOCUMENTS

| | | | |
|---|---|---|---|
| 791,101 | 5/1905 | Klein | 312/135 |
| 1,012,965 | 12/1911 | Bachrach | 312/117 |
| 1,059,781 | 4/1913 | Stephen | 312/125 X |
| 1,611,179 | 12/1926 | Fisher | 312/125 |
| 1,719,146 | 7/1929 | Stringer | 312/125 |
| 1,977,400 | 10/1934 | Offery et al. | 312/117 X |

*Primary Examiner*—James T. McCall
*Assistant Examiner*—Joseph Falk

[57] ABSTRACT

A display device for jewelry or the like, including a support stand and a plurality of interchangeable modules. The stand includes a planar receiving surface and fasteners are provided to temporarily attach the modules to the receiving surface. Each module has a planar support surface on which is disposed a display device for displaying the jewelry or the like. A window unit having a transparent front window is provided along with fasteners for temporarily attaching the window unit to the support surface. When received on said receiving surface, the support surfaces of the modules are disposed essentially parallel thereto.

11 Claims, 7 Drawing Figures

FIG. 1
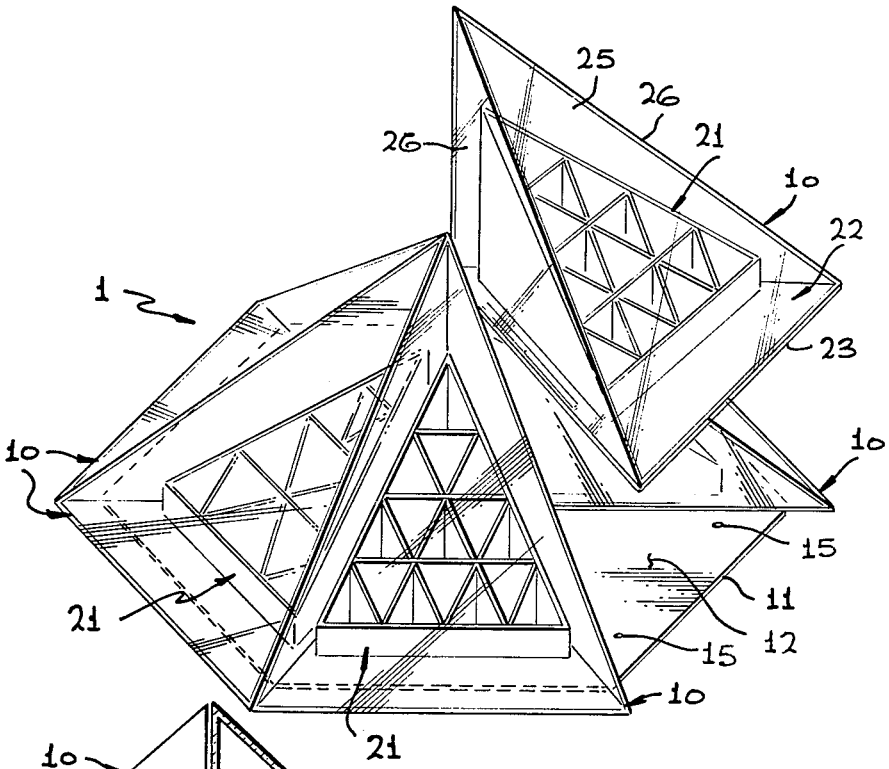
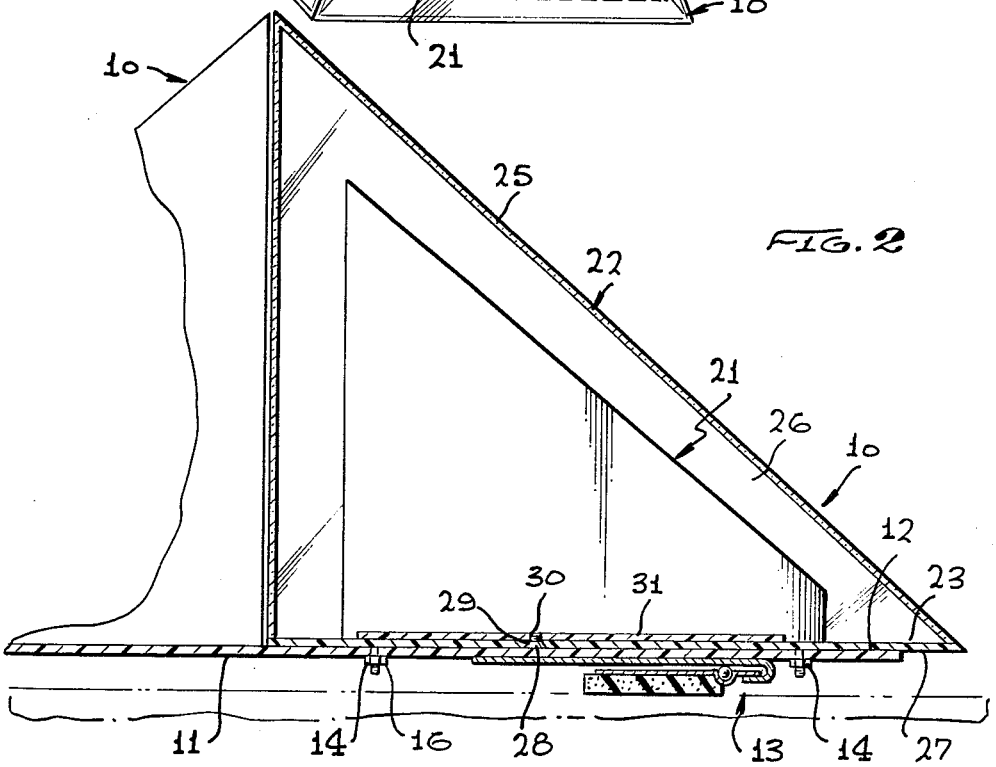
FIG. 2

FIG. 3
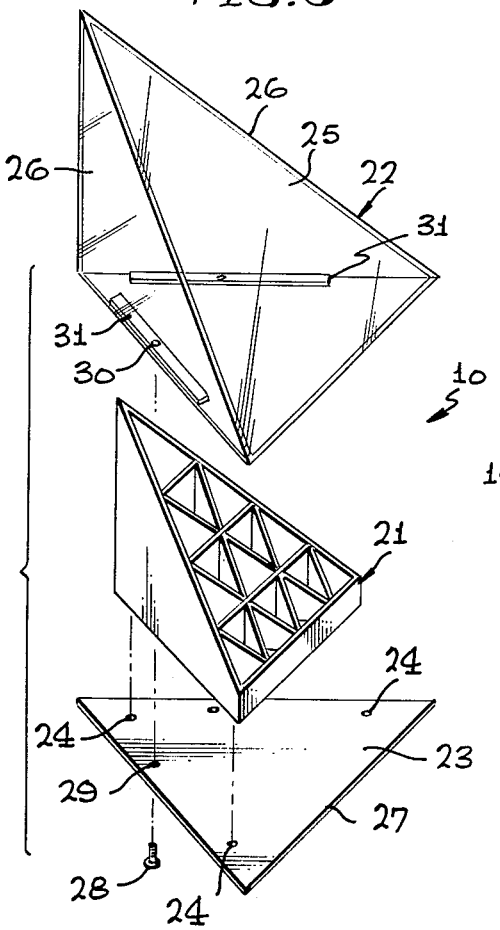
FIG. 4
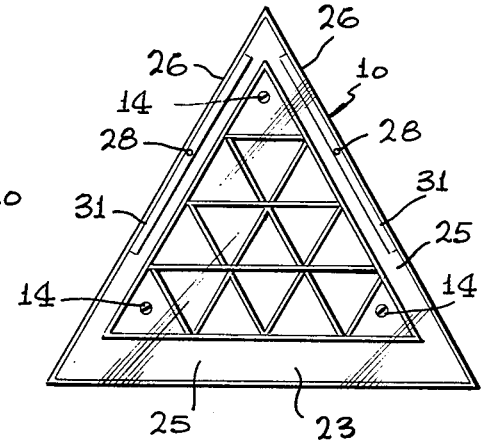
FIG. 5
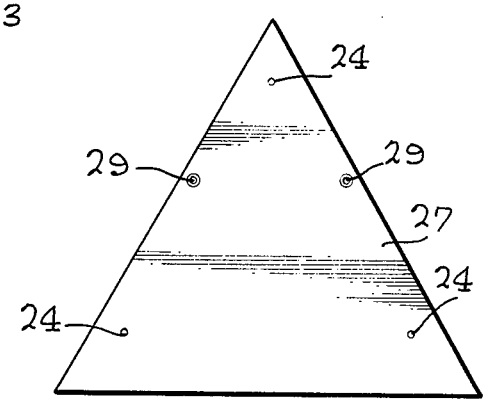
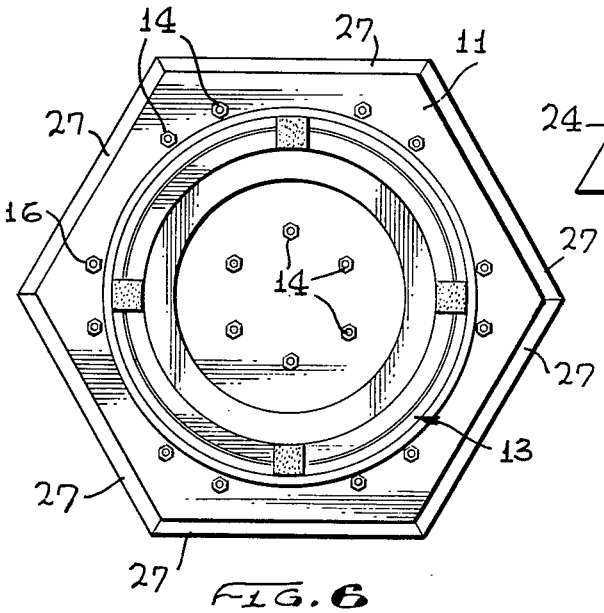
FIG. 6
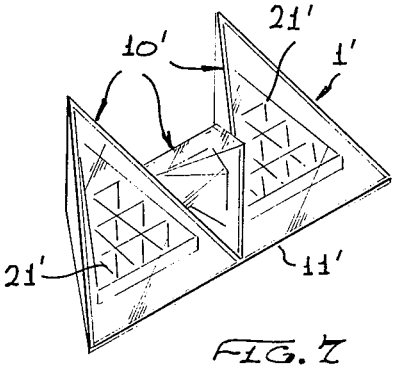
FIG. 7

DISPLAY CASE FOR JEWELRY AND THE LIKE

BACKGROUND OF THE INVENTION

Display cases are used in many stores to display items for sale, particularly small and valuable items which some members of the public might otherwise be tempted to misappropriate. As is well known, both floor mounted and counter mounted display cases are known. The present invention is directed to a counter mounted display case for displaying relatively small items for sale such as small items of jewelry.

In the prior art, counter mounted display cases have been utilized which are fully capable of displaying several items of jewelry or other small items and keeping them relatively secure. For example, prior art display cases are known which are formed of an upright cylinder of transparent plastic of about one foot in diameter and eighteen inches in height. An axially arranged rod holds two end caps securely in place and the displayed jewelry is supported from the rod.

The jewelry displayed in the case is preferably changed from time to time as the store changes its stock with the seasons. Usually the case remains the property of the distributor who sells the jewelry to the store. Typically the entire case is returned to the distributor for updating its contents while the distributor's sales force substitutes an updated case for the case presently being used at the store.

This requires the distributor to maintain a number of display cases merely to support the aforedescribed process of substitution and updating the contents of the cases. Of course, these display cases are not then being used to market jewelry. As might be expected, this prior art display case system requires considerable capital investment for (1) the display cases actively being used in the retail stores, (2) the jewelry sealed in those display cases, (3) the display cases reserved to support the substitution and updating process and (4) the jewelry in the last mentioned display cases.

It was therefore one object of the present invention to provide an improved display case for jewelry or the like items requiring less capital investment than the prior art designs and being relatively easy to update with new design items, yet secure.

It was another object to provide a case having modular display units.

BRIEF DESCRIPTION OF THE INVENTION

In accordance with the present invention, a display case is provided which has a plurality of interchangeable modules received on a support stand including a planar receiving surface for supporting the modules. Fastening devices are provided to temporarily fasten the modules to the receiving surface. Each of the modules includes a display device mounted on a planar support surface and a window unit including a transparent front window. Fastening devices are provided to temporarily fasten the window units to the support surfaces of the modules. The planar support surfaces are disposed essentially parallel and adjacent to the receiving surface when the modules are received on the support stand.

THE DRAWINGS

Other objects and advantages of the invention will be apparent from the following detailed description of an illustrative embodiment with reference to the following drawings in which:

FIG. 1 is a view in perspective of the modular dislpay case;

FIG. 2 is an enlarged partial side elevational view partially in section thereof;

FIG. 3 is an exploded perspective view of an individual module;

FIG. 4 is a plan view of an individual module;

FIG. 5 is a bottom view of an individual module;

FIG. 6 is an underside plan view of the complete assembly; and

FIG. 7 is a view in perspective of an alternative embodiment.

DETAILED DESCRIPTION OF THE PREFERRED EMBODIMENT

FIG. 1 depicts a view in perspective of the modular display case 1 with one of the modules 10 shown partially removed. The case 1 in this embodiment has six modules 10 and a support stand 11. The modules are securely, but releasably, attached to a planar receiving surface 12 on stand 11 by means of fastening devices 14, 16 (FIGS. 2 and 5). The stand 11 preferably includes a base with rotary bearing 13 to permit the case 1 to be easily rotated by potential customers desiring to view the items displayed in the individual modules 10.

Turning to FIGS. 2 through 6, each module 10 defines in plan view an equilateral triangle and includes a similarly shaped display device 21 mounted therein. Display devices 21 each hold a plurality of individual items being offered for sale, such as jewelry (i.e. rings, earrings, watches, etc.), which items are conventionally supported by small fabric cushions (not shown) disposed in the small triangular compartments therein.

Each module 10 is preferably fashioned of two units, a window unit 22 and a base unit 23, both made primarily of plastic materials. Window unit 22 includes a planar transparent plastic sloping front window 25 through which the items disposed on device 21 may be viewed and two preferably transparent side walls 26 integrally joined to window 25. The base unit 23 includes a planar bottom piece 27 to which device 21 is attached and the window unit 22 is securely, but releasably, attached thereto by means of fastening devices 28. As can be easily seen by reference to FIG. 2, fastening devices 28 preferably comprise countersunk machine screws which pass through holes 29 in bottom piece 27 to engage threaded holes 30 in flanges 31 on the inwardly facing edges of side walls 26.

When received on surface 12, all the side walls 26 of the window units 22 intersect in a common line which also defines the axis of rotation of rotary bearing 13 and the bottom pieces 27 are disposed adjacent to surface 12. Fastening devices 14, 16 are preferably provided by machine screws 14 and nuts 16. Machine screws 14 pass through openings in display device 21, openings 24 in bottom piece 27 and thence through openings 15 in receiving surface 12. The heads of screws 14 are hidden from view through window unit 22 by display device 21 and the cushions therein. Screws 14 engage nuts 16 to securely attach modules 10 to receiving surface 12 of stand 11.

When it is desired to substitute a module in use with a module having updated items, one merely unfastens nuts 16 of that module, removes it, replaces it with the updated module and refastens nuts 16 to the screws 14 emanating from the updated module after they have been passed through holes 15 in receiving surface 12.

The outdated module may then be disassembled when convenient by temporarily removing screws 28 permitting the window unit 22 to be separated from its base unit 23 and giving access to display device 21. Then one or more and perhaps all the items (i.e. pieces of jewelry and the like) may be easily replaced with updated items. Of course, screws 28 are thence returned to their normal positions locking the window unit 22 to the base unit 23.

DESCRIPTION OF ANOTHER EMBODIMENT

Turning to FIG. 7 there is depicted an alternative embodiment which may be used alone or in combination with the just described preferred embodiment. The display case 1'' of FIG. 7 is shown having three modules 10'' arranged side-to-side such that the windows 25'' of alternating modules 10'' share a common plane.

The modules 10'' are preferably identical to the modules 10 previously described with reference to FIGS. 2–6. Thus display cases 1'' may be used in those applications where fewer modules are required, yet full interchangeability is provided between the modules used on the display case 1 of FIG. 1 and the display case 1'' of FIG. 7.

Case 1'' preferably has an appropriately shaped receiving surface 11'' for securing modules 10'' thereto.

Having described the invention with respect to certain specific embodiments thereof, modification will now suggest itself to those skilled in the art. The invention itself is not to be limited to the embodiments disclosed except as required by the accompanying claims.

What is claimed is:

1. A display case comprising:

(a) a plurality of interchangeable modules;

(b) a support stand including a planar receiving surface for supporting said modules thereon;

(c) means for temporarily fastening said modules to said stand;

(d) each of said modules including a planar support surface, a display device affixed to said planar support surface, a window unit including a transparent front window and means for temporarily fastening said window unit to said planar support surface, said planar support surface being disposed essentially parallel to and adjacent said planar receiving surface when said modules are supported by said support stand.

2. The display case according to claim 1, wherein said transparent front windows comprise planar surfaces and each of the transparent front windows of said plurality of modules lie in different planes when said plurality of modules are supported by said stand.

3. The display case according to claim 2, wherein said stand includes a base and means for permitting relative rotary movement between said base and said receiving surface.

4. The display case according to claim 3, wherein said planar support surfaces each define an equilateral triangle.

5. The display case according to claim 4, wherein said window units each include a plurality of transparent side walls integrally formed with said transparent front window.

6. The display device according to claim 5, wherein the planes occupied by said transparent front windows intersect at a point lying on the axis of said means for permitting relative rotary movement.

7. The display device according to claim 1, wherein said transparent front windows comprise planar surfaces and each of the transparent front windows of all of said plurality of modules intersect at only a common point when said plurality of modules are supported by said stand.

8. A display device comprising:

a. a plurality of interchangeable modules; and b. a support stand including a receiving surface for supporting said modules thereon;

c. each of said modules including:

(i) a planar support surface having three edges;

(ii) three triangular, planar walls arranged to form a pyramid;

(iii) means for temporarily attaching said pyramid to said planar support surface;

(iv) said planar support surface being disposed essentially parallel to and adjavent said planar receiving surface and two walls of each of said pyramids being disposed essentially parallel to and adjacent a wall of an adjacent pyramid when said modules are supported by said support stand.

9. The display of claim 8, wherein said modules further include a display device supported on said surface, said display device comprising:

a. two four-sided planar members, two of the sides of each planar member being arranged at a right angle to each other and one of the sides of each planar member being considerably shorter than the remaining three sides of each planar member, one of the sides adjacent said right angle of each planar member being attached to a corresponding side of the other planar member; and b. a rectangular member having a pair of sides considerably shorter than the other two remaining sides thereof, the two considerably shorter sides being of the same length and attached to respective considerably shorter sides of said two planar members.

10. The display stand of claim 9, wherein said display device further includes a plurality of planar separators, each of which is attached to two of said planar and rectangular members and arranged parallel to another one of said planar and rectangular members.

11. The display stand of claim 8, wherein two of the triangular walls of each of said modules are vertically disposed when said modules are supported by said support stand and the receiving surface thereof is horizontally disposed.

* * * * *